US006879881B1

(12) United States Patent
Attridge, Jr.

(10) Patent No.: US 6,879,881 B1
(45) Date of Patent: Apr. 12, 2005

(54) VARIABLE AIR VOLUME SYSTEM INCLUDING BTU CONTROL FUNCTION

(76) Inventor: Russell G. Attridge, Jr., 67 Burkehaven Hill Rd., Sunapee, NH (US) 03782

( * ) Notice: Subject to any disclaimer, the term of this patent is extended or adjusted under 35 U.S.C. 154(b) by 0 days.

(21) Appl. No.: 10/704,251

(22) Filed: Nov. 7, 2003

Related U.S. Application Data

(60) Provisional application No. 60/512,495, filed on Oct. 17, 2003.

(51) Int. Cl.[7] ..... G01M 1/38; G05B 13/00; G05B 15/00; F24F 3/00; G05D 23/00

(52) U.S. Cl. ..... 700/277; 236/1 B; 165/217

(58) Field of Search ..... 700/276, 277, 700/278, 281, 282; 236/1 B, 1 G, 49.3; 165/205, 212, 217

(56) References Cited

U.S. PATENT DOCUMENTS

| | | | | |
|---|---|---|---|---|
| 4,182,484 A | | 1/1980 | Stanke et al. | |
| 4,530,395 A | | 7/1985 | Parker et al. | |
| 4,635,445 A | | 1/1987 | Otsuka et al. | |
| 4,732,318 A | | 3/1988 | Osheroff | |
| 4,754,919 A | | 7/1988 | Otsuka et al. | |
| 4,890,666 A | | 1/1990 | Clark | |
| 5,004,149 A | | 4/1991 | Narikiyo et al. | |
| 5,024,265 A | | 6/1991 | Buchholz et al. | |
| 5,076,346 A | | 12/1991 | Otsuka | |
| 5,172,565 A | | 12/1992 | Wruck et al. | |
| 5,179,524 A | | 1/1993 | Parker et al. | |
| 5,209,398 A | * | 5/1993 | Drees | 236/91 F |
| 5,355,305 A | | 10/1994 | Seem et al. | |
| 5,506,768 A | | 4/1996 | Seem et al. | |
| 5,535,814 A | | 7/1996 | Hartman | |
| 5,544,697 A | | 8/1996 | Clark | |
| 5,568,377 A | | 10/1996 | Seem et al. | |
| 5,605,280 A | | 2/1997 | Hartman | |
| 5,768,121 A | | 6/1998 | Federspiel | |
| 5,769,314 A | | 6/1998 | Drees et al. | |
| 5,769,315 A | | 6/1998 | Drees | |
| 5,829,674 A | | 11/1998 | Vanostrand et al. | |
| 5,875,109 A | | 2/1999 | Federspiel | |
| 6,000,232 A | | 12/1999 | Witten-Hannah et al. | |
| 6,006,142 A | | 12/1999 | Seem et al. | |
| 6,089,464 A | * | 7/2000 | Morgan | 236/49.3 |
| 6,219,590 B1 | * | 4/2001 | Bernaden et al. | 700/277 |
| 6,250,560 B1 | | 6/2001 | Kline et al. | |
| 6,296,193 B1 | * | 10/2001 | West et al. | 236/13 |
| 6,298,912 B1 | | 10/2001 | Rayburn et al. | |
| 6,408,228 B1 | | 6/2002 | Seem et al. | |
| 6,430,985 B1 | * | 8/2002 | Drees | 73/1.34 |
| 6,477,439 B1 | * | 11/2002 | Bernaden et al. | 700/103 |
| 6,488,081 B2 | | 12/2002 | Rayburn et al. | |
| 6,789,618 B2 | * | 9/2004 | Pearson | 165/210 |

OTHER PUBLICATIONS

Ashrae Journal, Jun., 2003, "Improving VAV Zone Control," Thomas Hartman, P.E.

* cited by examiner

*Primary Examiner*—Leo Picard
*Assistant Examiner*—R Jarrett
(74) *Attorney, Agent, or Firm*—Hoffmann & Baron, LLP

(57) ABSTRACT

A method, as well as a controller, for controlling room temperature with a variable air volume system having a plurality of zones wherein the thermal transfer rate with respect to each of such zones is maintained at a substantially constant value notwithstanding changes in the temperature of the supply air thereby providing improved efficiency and environmental comfort.

30 Claims, 4 Drawing Sheets

| BOX No | CFM VBTU | CFM VAV | Room Set Point | Room Temp | Dev Deg | SAT | BTU VBTU | BTU |
|---|---|---|---|---|---|---|---|---|
| 1 | 1000 | 1000 | 75 | 76.5 | +1.5 | 56.2 | 21924 | 21924 |
| 2 | 662.4 | 1000 | 75 | 75.75 | +0.75 | 56.2 | 13986 | 21114 |
| 3 | 653.5 | 1000 | 75 | 75.25 | +0.25 | 56.2 | 13446 | 20574 |
| 4 | 648.9 | 1000 | 75 | 75 | 0 | 56.2 | 13176 | 20304 |
| 5 | 648.9 | 986.7 | 73 | 72.9 | -0.1 | 56.2 | 10762.9 | 17796 |
| 6 | 607.1 | 1000 | 73 | 73 | 0 | 56.2 | 11016 | 18144 |
| 7 | 629.2 | 1000 | 74 | 74 | 0 | 56.2 | 12096 | 19224 |
| 8 | 639.3 | 1000 | 74 | 74.5 | +0.5 | 56.2 | 12636 | 19764 |
| 9 | 515.4 | 833.25 | 74 | 73.5 | -0.5 | 56.2 | 9629 | 15568.4 |
| 10 | 574 | 920 | 74 | 73.75 | -0.25 | 56.2 | 10879.9 | 17437.7 |
| Total | 6526.5 | 9739.95 | | | | | 129551.8 | 191850.1 |
| Difference | 49.24% | | | | | | 48.08% | |

FIG. 3

10 VAV Boxes Max 1000 CFM Min 333 CFM

| BOX No | CFM | Room Set Point | Room Temp | Dev Deg | SAT | ΔT | BTU |
|---|---|---|---|---|---|---|---|
| 1 | 1000 | 75 | 76 | +1 | 62.8 | 13.2 | 14256 |
| 2 | 1000 | 75 | 75.75 | +0.75 | 62.8 | 12.95 | 13986 |
| 3 | 1000 | 75 | 75.25 | +0.25 | 62.8 | 12.45 | 13446 |
| 4 | 1000 | 75 | 75 | 0 | 62.8 | 12.2 | 13176 |
| 5 | 986.7 | 73 | 72.9 | -0.1 | 62.8 | 10.1 | 10762.9 |
| 6 | 1000 | 73 | 73 | 0 | 62.8 | 10.2 | 11016 |
| 7 | 1000 | 74 | 74 | 0 | 62.8 | 11.2 | 12096 |
| 8 | 1000 | 74 | 74.5 | +0.5 | 62.8 | 11.7 | 12636 |
| 9 | 833.25 | 74 | 73.5 | -0.5 | 62.8 | 10.7 | 9629 |
| 10 | 920 | 74 | 73.75 | -0.25 | 62.8 | 10.95 | 10879.9 |
| Total | 9739.95 | | | | | | 121883.8 |
| | | | | | | | |
| | | | | | | | |

FIG. 4

10 VAV Boxes Max 1000 CFM Min 333 CFM

| BOX No | CFM | Room Set Point | Room Temp | Dev Deg | SAT | ΔT | BTU |
|---|---|---|---|---|---|---|---|
| 1 | 1000 | 75 | 76.5 | +1.5 | 56.2 | 20.3 | 21924 |
| 2 | 1000 | 75 | 75.75 | +0.75 | 56.2 | 19.55 | 21114 |
| 3 | 1000 | 75 | 75.25 | +0.25 | 56.2 | 19.05 | 20574 |
| 4 | 1000 | 75 | 75 | 0 | 56.2 | 18.8 | 20304 |
| 5 | 986.7 | 73 | 72.9 | -0.1 | 56.2 | 16.7 | 17796 |
| 6 | 1000 | 73 | 73 | 0 | 56.2 | 16.8 | 18144 |
| 7 | 1000 | 74 | 74 | 0 | 56.2 | 17.8 | 19224 |
| 8 | 1000 | 74 | 74.5 | +0.5 | 56.2 | 18.3 | 19764 |
| 9 | 833.25 | 74 | 73.5 | -0.5 | 56.2 | 17.3 | 15568.4 |
| 10 | 920 | 74 | 73.75 | -0.25 | 56.2 | 17.55 | 17437.7 |
| Total | 9739.95 | | | | | | 191850.1 |
| | | | | | | | |
| | | | | | | | |

FIG. 5

10 VAV Boxes Max 1000 CFM Min 333 CFM

| BOX No | CFM | Room Set Point | Room Temp | Dev Deg | SAT | ΔT | BTU |
|---|---|---|---|---|---|---|---|
| 1 | 1000 | 75 | 76.5 | +1.5 | 56.2 | 20.3 | 21924 |
| 2 | 662.4 | 75 | 75.75 | +0.75 | 56.2 | 19.55 | 13986 |
| 3 | 653.5 | 75 | 75.25 | +0.25 | 56.2 | 19.05 | 13446 |
| 4 | 648.9 | 75 | 75 | 0 | 56.2 | 18.8 | 13176 |
| 5 | 648.9 | 73 | 72.9 | -0.1 | 56.2 | 16.7 | 10762.9 |
| 6 | 607.1 | 73 | 73 | 0 | 56.2 | 16.8 | 11016 |
| 7 | 629.2 | 74 | 74 | 0 | 56.2 | 17.8 | 12096 |
| 8 | 639.3 | 74 | 74.5 | +0.5 | 56.2 | 18.3 | 12636 |
| 9 | 515.4 | 74 | 73.5 | -0.5 | 56.2 | 17.3 | 9629 |
| 10 | 574 | 74 | 73.75 | -0.25 | 56.2 | 17.55 | 10879.9 |
| Total | 6526.5 | | | | | | 129551.8 |
| | | | | | | | |
| | | | | | | | |

FIG. 6

| BOX No | CFM VBTU | CFM VAV | Room Set Point | Room Temp | Dev Deg | SAT | BTU VBTU | BTU |
|---|---|---|---|---|---|---|---|---|
| 1 | 1000 | 1000 | 75 | 76.5 | +1.5 | 56.2 | 21924 | 21924 |
| 2 | 662.4 | 1000 | 75 | 75.75 | +0.75 | 56.2 | 13986 | 21114 |
| 3 | 653.5 | 1000 | 75 | 75.25 | +0.25 | 56.2 | 13446 | 20574 |
| 4 | 648.9 | 1000 | 75 | 75 | 0 | 56.2 | 13176 | 20304 |
| 5 | 648.9 | 986.7 | 73 | 72.9 | -0.1 | 56.2 | 10762.9 | 17796 |
| 6 | 607.1 | 1000 | 73 | 73 | 0 | 56.2 | 11016 | 18144 |
| 7 | 629.2 | 1000 | 74 | 74 | 0 | 56.2 | 12096 | 19224 |
| 8 | 639.3 | 1000 | 74 | 74.5 | +0.5 | 56.2 | 12636 | 19764 |
| 9 | 515.4 | 833.25 | 74 | 73.5 | -0.5 | 56.2 | 9629 | 15568.4 |
| 10 | 574 | 920 | 74 | 73.75 | -0.25 | 56.2 | 10879.9 | 17437.7 |
| Total | 6526.5 | 9739.95 | | | | | 129551.8 | 191850.1 |
| Differ-ence | 49.24% | | | | | | 48.08% | |
| | | | | | | | | |

VARIABLE AIR VOLUME SYSTEM INCLUDING BTU CONTROL FUNCTION

This application claims the benefit of U.S. Provisional Application Ser. No. 60/512,495 filed on Oct. 17, 2003.

BACKGROUND OF INVENTION

The present invention relates to a variable air volume system and, more particularly, to a variable air volume system having a plurality of zones wherein the thermal transfer rate with respect to each of such zones is controlled for improved efficiency and environmental comfort.

Heating, ventilating and air-conditioning (HVAC) systems are used to both heat and cool the air within an enclosure, e.g., a building or zone within such building. An HVAC system typically includes a heating unit, a cooling unit, a supply air fan, a supply duct for directing air into the enclosure, and a return duct for removing air from the enclosure. It will be appreciated by those skilled in the art that HVAC systems are generally designed to operate in one of three modes: a heating mode to heat the enclosure, a cooling mode to cool the enclosure and a economizer mode to ventilate the enclosure, as well as cool the enclosure under certain conditions. The economizer mode typically utilizes an outdoor air damper, commonly referred to as an economizer, that can be selectively opened to allow the return air to mix with fresh outside air.

As will be recognized by those skilled in the art, there is typically a control system associated with an HVAC system, such control system including a thermostat (typically located within the enclosure) and associated hardware/software for controlling the components of the particular HVAC system in response to preprogrammed instructions. Typically, the control system allows a user to pre-select one of the three operating modes, as well as selecting a desired temperature for the enclosure. Thereafter, the control system activates either the heating or cooling portion of the HVAC system to maintain the pre-selected temperature within the enclosure. Under certain conditions the economizer mode may be able to maintain the enclosure at the pre-selected temperature.

One common HVAC system is referred to as a variable air volume (VAV) system. A VAV system utilizes individual flow control boxes which control the air flow from a main supply duct into an individual zone of a building, e.g., an office, conference room, etc. Particularly, the individual flow control boxes regulate the volume of air flow entering the zone between a minimum flow volume and a maximum flow volume, generally by moving a damper or valve in the flow control box. The damper is moved in response to changes in the temperature in the room as measured by a thermostat in such room. The measured room temperature is compared to a room set point temperature, and the air flow entering the room (whether cold air for cooling or hot air for heating) is regulated accordingly.

Many VAV systems are designed to operate with a fixed supply air temperature (e.g., 55° F. in cooling mode). Other VAV systems are designed to regularly reset the supply air temperature (e.g., 55° F.–60° F. in cooling mode) in response to the thermal load. In either system, the supply air temperature can undergo a significant temperature change over a very short period of time. Particularly, a VAV system utilizing an on/off heating or cooling unit will experience a significant temperature swing each time the unit is cycled on or off. For example, if an additional stage of a direct expansion (DX) cooling unit is turned on, there will be a sudden decrease in the temperature of the supply air (e.g., 5°–7° F.). Likewise, turning off a stage of a DX cooling system will result in a sudden increase in the temperature of the supply air (e.g., 5°–7° F.). Conventional systems continuously cycle the heating or cooling units to maintain the temperature of the supply air at the selected point.

Those skilled in the art will appreciate that changes in the temperature of the supply air in a variable air volume system often result in uncomfortable temperature swings within the individual zones. Ideally, the flow control box maintains the room temperature of the zone at the desired set point by opening and closing the damper, thus regulating the volume of air entering the zone. If, for example, a VAV box is allowing approximately 1,000 $ft^3$/min of cold air to enter the zone to maintain the temperature of the zone at the desired set point (or within the designed temperature range), it will be appreciated that a decrease in the temperature of the supply air (assuming the system is in a cooling mode) will result in the overcooling of the zone.

Specifically, the flow control box will continue to allow the same amount of air (e.g., 1,000 $ft^3$/min) to enter the zone, but because the supply air is at a decreased temperature, the temperature in the zone will decrease. This decrease in temperature will likely bring the temperature of the zone outside of the designed temperature range, and into an uncomfortable zone for the occupants. Due to the inherent time delays associated with all HVAC systems, the room will have already reached the undesirable temperature before the system can signal the flow control box to decrease the flow of air into the zone. Stated differently, the flow control box will eventually decrease the flow of air into the zone based on the room temperature falling below the set point temperature, but this will happen in effect "after the fact."

A similar event will occur if the supply air temperature suddenly rises (due to a stage of cooling being turned off) in which case the temperature in the zone may rise to an uncomfortable level before the system signals the flow control box to increase the flow of air into the zone. Of course, these same undesirable temperature swings are experienced when the system is in a heating mode or when the supply air temperature is reset, either automatically or by a system operator.

As mentioned, certain prior art VAV systems are designed to reset the supply air temperature. These systems, although having the capability to reset the supply air temperature over a limited range by, for example, measuring the temperature of the return air, do not actually match the temperature of the supply air to meet the thermal load on the system. For example, the system may only need supply air at 65° F. to satisfy the total cooling load, but will nonetheless continue supplying air at 60° F. (or lower) in accordance with the system's specifications. Such systems are therefore unable to realize this potential savings in energy costs. Likewise, the prior art VAV systems may overheat the supply air when the system is in a heating mode.

In addition to this mentioned inefficiency in prior art VAV systems, overcooling of the supply air often results in environmental discomfort to the occupants of the building. Because the supply air is colder than necessary, the flow control boxes will need to restrict the flow of air into the various zones. This decrease in air flow can result in a problem referred to as "dumping", which results when the exit velocity of the supply air into the zone is too low to adequately mix the cold supply air with the warmer room air thus causing the cold supply air to simply "dump" into the zone and onto the occupants. Moreover, the restricted air flow into the zones also reduces the indoor air quality (IAQ) in such zones.

Finally, the flow control boxes of prior art VAV systems are unable to provide an indication of an existing unmet cooling/heating load in a particular zone(s). For example, a prior art flow control box can provide an output signal indicating that the box is providing maximum flow volume into the zone. However, this prior art output signal does not indicate whether this maximum flow volume is satisfying the thermal load in the zone or whether additional cooling/heating is still required. Typically, additional cooling/heating in a VAV system is provided by resetting the temperature of the supply air. In practice, this unmet cooling/heating load in a prior art VAV system will only be discovered through occupant complaints that the zone is either too hot or too cold.

There is therefore a need in the art for a method of controlling a variable air volume system, as well as a controller, which anticipates and limits/prevents the undesirable temperature swings in the various zones of a building which result from the changes in temperature of the supply air due to system resetting and/or to cycling of the heating/cooling unit. There is a further need in the art for a VAV system which can provide a signal for the resetting of the supply air temperature in response to the thermal load on the building thereby realizing savings in energy costs, improving environmental comfort and improving indoor air quality. Finally, there is a need in the art for a VAV system which can provide an indication of an existing unmet cooling/heating load in a particular zone of the building.

SUMMARY OF THE INVENTION

The present invention, which addresses the needs of the prior art, relates to a method of controlling room temperature within a zone of a variable air volume system. The system includes a flow control box associated with the zone for regulating flow volume of supply air into the zone. The supply air has a temperature T. The method includes the step of calculating a thermal transfer rate for the zone based upon the supply air temperature and the flow volume into the zone. The method includes the further step of calculating an adjusted air flow volume for the zone in response to a change in the supply air temperature while maintaining the thermal transfer rate at a substantially constant value. Finally, the method includes the step of setting the flow control box to the adjusted air flow volume whereby the thermal transfer rate with respect to the zone remains at the substantially constant value notwithstanding the change in temperature of the supply air thus substantially maintaining the temperature within a predefined temperature range.

The present invention also relates to a controller for controlling room temperature within a zone of a variable air volume system. The system includes a flow control box associated with the zone for regulating flow volume of the supply air into the zone. The supply air has a temperature T. The controller includes at least one processor circuit for calculating a thermal transfer rate for the zone based upon the supply air temperature and the flow volume into the zone and for calculating an adjusted flow volume for the zone in response to a change in the supply air temperature while maintaining the thermal transfer rate at a substantially constant value. The controller also includes an electrical output device for communicating the adjusted flow volume to the flow control box whereby the thermal transfer rate with respect to the zone remains at the substantially constant value notwithstanding the change in temperature of the supply air thus substantially maintaining the room temperature within a predefined temperature range.

The present invention further relates to a variable air volume system for environmental control of a plurality of zones within a building. The system includes at least one air handling unit for providing supply air at a preselected temperature. The system further includes a supply duct for transporting supply air from the air handling unit to the individual zones. The system also includes a flow control box associated with each of the zones for regulating flow volume of supply air into the associated zones. Finally, the system includes at least one controller for controlling the room temperature within each of the zones. The controller includes at least one processor circuit for calculating a thermal transfer rate for the zone based upon the supply air temperature and the flow volume into the zone and for calculating an adjusted flow volume for the zone in response to a change in the supply air temperature while maintaining the thermal transfer rate at a substantially constant value. The controller further includes an electrical output device for communicating the adjusted flow volume to the flow control box whereby the thermal transfer rate with respect to the zone remains at the substantially constant value notwithstanding the change of temperature of the supply air thus substantially maintaining the room temperature within a predefined temperature range. The processor circuit utilizes the formula: Thermal Transfer Rate (BTU/hour)=Flow Volume (Cubic Feet Per Minute)×1.08×(Room Temperature−Supply Air Temperature).

The present invention additionally relates to a method of improving environmental comfort in a variable air volume system having a plurality of zones. The system includes a flow control box associated with each of the zones for individually regulating the flow volume of supply air into each of the zones to maintain room temperature of the individual zones at or near preselected set points. The supply air is provided at a preselected temperature T. The method includes the step of determining the flow volume of the supply air flowing through the boxes. The method includes the further step of adjusting the supply air temperature to increase the flow volume through the boxes when at least one of the boxes is operating in a restricted flow mode whereby environmental comfort is improved.

Finally, the present invention relates to a method of controlling a variable air volume system having a plurality of zones. The system includes a flow control box associated with each of the zones for regulating flow volume of supply air into each of the zones. The supply air is provided at a temperature T. The method includes the step of providing an output signal at each of the flow control boxes corresponding to a predetermined proportional band. A first portion of the proportional band corresponds to control of the flow control box and a second portion of the proportional band provides an indication of unmet thermal load in the respective zone. The method includes the further step of monitoring the boxes to identify select boxes wherein the output signal corresponds to the second portion of the proportional band. Finally, the method includes the step of providing a reset signal for adjustment of the supply air temperature in accordance with predefined system criteria when the output signal from the select boxes corresponds to the second portion of the proportional band.

As a result, the present invention provides a method of controlling a variable air volume system, as well as a controller, which anticipates and limits/prevents the undesirable temperature swings in the various zones of a building which result from the changes in temperature of the supply air due to system resetting and/or to cycling of the heating/cooling unit. The present invention further provides a VAV system which can provide a signal for the resetting of the supply air temperature in response to the thermal load in the building thereby realizing savings and energy costs, improving the environmental comfort and improving indoor air quality. Finally, the present invention provides a VAV system which can provide an indication of an existing unmet cooling/heating load in a particular zone of a building.

BRIEF DESCRIPTION OF THE DRAWINGS

FIG. 3 is a table depicting selected data for ten individual zones of a VAV system;

FIG. 4 is a table, similar to FIG. 3, depicting the individual responses of Zones 1–10 to a 0.5° increase in room temperature of Zone No. 1 in a conventional VAV system;

FIG. 5 is a table, similar to FIG. 3, depicting the individual responses of Zones 1–10 to a 0.5 increase in room temperature of Zone No. 1 in the VAV system of the present invention; and FIG. 6 is a table comparing the data of FIGS. 4 and 5.

DETAILED DESCRIPTION OF THE INVENTION

Figure 1:
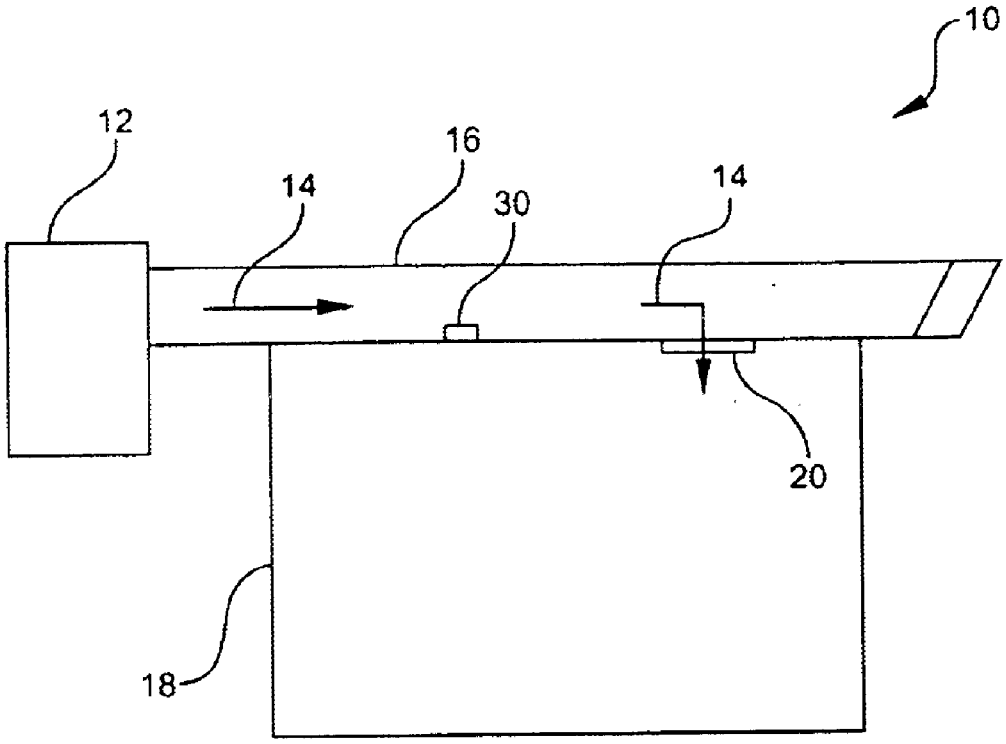
FIG. 1 is a graphical representation of the variable air volume system including BTU control function of the present invention.
Figure 1A:
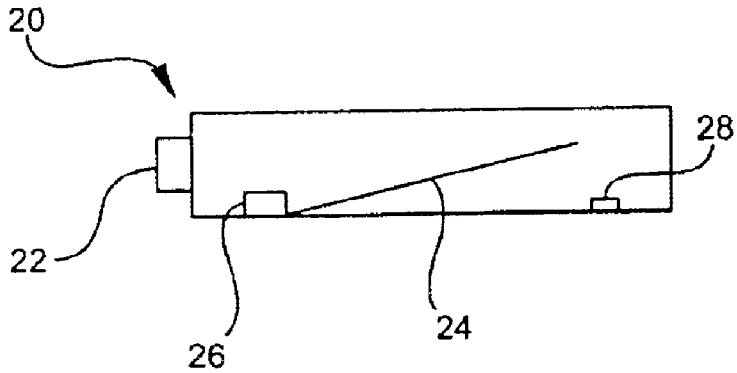
FIG. 1*a* is a graphical representation of the flow control box of the present invention.

Referring now to FIG. 1, variable air volume (VAV) system 10 includes a heating, ventilating and air conditioning (HVAC) package 12 for supplying cold or heated supply air 14 (as well as fresh outside air) into a supply air duct 16. A plurality of zones 18 (e.g., an office, conference room, etc.) communicate with supply duct 16 through a plurality of flow control boxes 20 (e.g., pressure independent variable air volume boxes). Typically, each individual zone 18 has at least one flow control box directly associated therewith. VAV system 10 preferably includes a plurality of controllers 22, one controller being associated with each of the individual flow control boxes. However, it is contemplated herein that VAV system 10 can also utilize a single central controller to communicate with all the individual flow control boxes.

Each of flow control boxes 20 preferably includes a movable damper 24 for regulating flow volume between a selected minimum flow volume (e.g., 333 $ft^3$/min) and a selected maximum flow volume (e.g., 1000 $ft^3$/min), as well as an actuator 26 for moving the damper. Each of the flow control boxes also preferably includes a flow sensor 28 for measuring the volume of air flowing through the box. In one preferred embodiment, flow sensor 28 is configured to measure the velocity of the supply air traveling therepast. Based upon the flow area of the box, the volume of supply air traveling through the box can be calculated regardless of changes of the pressure in the supply air duct.

Controller 22 is preferably mounted on the flow control box, and in electrical communication with the actuator that moves the damper. In one preferred embodiment, each of the individual controllers are connected to one another by, for example, a Peer-to-Peer network, which allows information from each flow control box to be shared throughout the system. In a system utilizing a single central controller, such controller would be connected to and communicate with the individual flow control boxes. For example, a single central controller could monitor the thermal load in each zone, the air flow volume into each zone, the set point in each zone, and the actual measured room temperature in each zone. Alternatively, these same criteria (with respect to each zone) could be monitored by individual controllers associated with each box.

System 10 includes at least one sensor 30 for measuring the temperature of supply air 16. In one embodiment, each flow control box includes a sensor for measuring the supply air temperature, thus providing the flow control box with "stand alone" capability. This "stand alone" capability is necessary in systems wherein the controllers are not networked together. Alternatively, system 10 could utilize a single sensor or multiple sensors located at predetermined locations for measuring supply air temperature, the measured temperature being provided to each of the individual controllers over the connecting network. The readings from the multiple sensors could be averaged together to provide an average supply air temperature.

Controller 22 is responsible for performing at least two separate tasks. The first task relates to changes in the sensible thermal load within individual zone 18. The sensible thermal load is determined by calculating the deviation between the measured room temperature and the preselected set point temperature for the zone. As the sensible thermal load changes, controller 22 will regulate the volume of supply air passing through flow control box 20. This is accomplished by signaling actuator 26 to move damper 24 to allow more or less supply air into zone 18 in an effort to maintain the room temperature within a predefined temperature range. In one preferred embodiment, a change in a room temperature of 0.2° F. provides a 10% change in flow volume. This correlation is, of course, adjustable, depending on the characteristics of the particular system and the selected design criteria.

The mentioned predefined temperature range encompasses the selected room set point temperature, and is preferably less than or equal to ±1.0° F. with respect to this set point. In one preferred embodiment, the predefined temperature range is less than or equal to ±0.5° F. with respect to the selected set point temperature.

Figure 2:
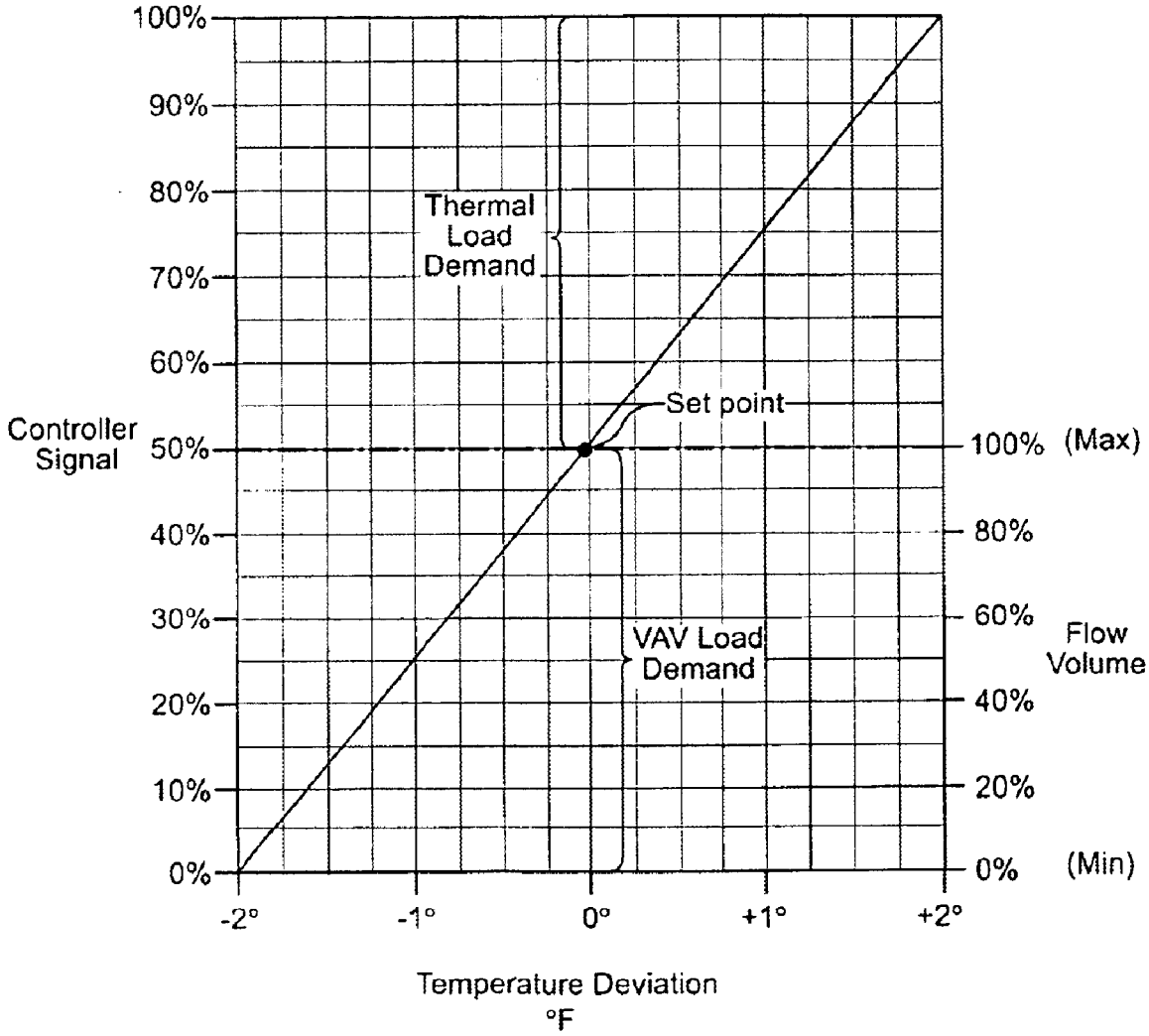
FIG. 2 is a graphical relationship of the VAV load demand and cooling load demand of the VAV system of the present invention.

This first task of controller 22 can be more fully understood by reference to FIG. 2. Controller 22 preferably provides an output signal ranging from 0%–100%. The output signal of the controller is plotted on the Y axis of a graph (as shown in FIG. 2), while the X axis of the graph is used to represent a second variable, e.g., temperature deviation (wherein temperature deviation is equal to room temperature minus set point temperature). The range of values for the temperature deviation axis is preselected by the system designer/operator. In one preferred embodiment (as shown in FIG. 2), the temperature deviation scale has a range of 4°, i.e., it extends from −2° to +2°. The range of the scale is, of course, adjustable, and can be increased or decreased with respect to various systems and in response to operational considerations.

In one preferred embodiment, one end of the temperature deviation scale is assigned an output signal value of 0%, while the other end of the temperature deviation scale is assigned an output signal value of 100%. The relationship of the temperature deviation to the output signal is preferably proportional between the mentioned endpoints, thereby establishing a proportional band as shown in FIG. 2. A temperature deviation of 0 (which correspond to an output signal of 50%) is selected to represent a set point reference, i.e., the set point temperature for the room. Thus, if the room temperature equals the set point temperature, the deviation is equal to 0 and the controller will provide an output signal of 50%.

As shown in FIG. 2, the controller output signal of 0–50% may be used to control the flow volume through the flow control box, and is referred to as the VAV load demand band. More particularly, the components of the system may be configured such that a controller output signal of 0 corresponds to a minimum flow setting through the flow control box, while a controller output signal of 50% corresponds to a maximum flow volume through the flow control box. Controller output signals of between 0% and 50% relate proportionally to flow volumes between minimum and maximum.

As mentioned, an output signal of 50% corresponds to a temperature deviation of 0. Thus, when the room temperature in the zone is at set point, the controller provides an output signal of 50% which corresponds to a condition of maximum flow volume through the flow control box. It will be appreciated by those skilled in the art that maximum flow is desired in that it ensures indoor air quality, eliminates the problem of "dumping", and is representative of an efficient state of operation (as discussed further hereinbelow).

For example, if the set point for the zone is 72° and the measured room temperature is 74°, a +20 temperature deviation is measured. Thus, controller 22 will attempt to cool the room by increasing the flow of supply air 16 into zone 18. The plotted relationship of FIG. 2 shows that flow control box 20 will maintain maximum flow volume until such time as the deviation from set point falls below zero, i.e., until such time as the temperature in the room falls below the zone set point. Based on the relationship shown in FIG. 2, the volume of supply air directed into zone 18 will be decreased as the temperature in the enclosure falls below the zone set point. As mentioned, if the temperature in the enclosure falls 2° below the zone set point, the flow control box will restrict flow volume to the minimum flow volume position.

As shown, the VAV load demand relationship is a generally proportional relationship. That is, each unit change in temperature corresponds to a unit change in flow volume (e.g., each 0.2° F. change in temperature corresponds to a 10% change in flow volume). It is to be noted that the minimum and maximum flow volume values are adjustable and are typically calculated during the initial design of the system, taking into consideration the environmental characteristic of the zone as well as the size of the flow control box for that particular zone.

FIG. 2 shows the proportional band used by controller 22 when the system is in cooling mode. If the system is in heating mode, the plot will be revised accordingly. More particularly, the controller will provide maximum flow volume into the zone during heating when the room temperature in the zone is below set point, i.e., the room is too cold.

The upper portion of the curve of FIG. 2 is referred to as the thermal load demand band. This portion of the curve preferably corresponds to the second half of the signal range of controller 22. Particularly, the thermal load demand band corresponds to a controller output signal of between 50% and 100%.

The thermal load demand band signal is an indication of the thermal load in the zone, and can be monitored to reset the supply air temperature, either manually by a system operator or automatically if the controller can communicate directly with the air handling unit, e.g., HVAC package 12. When in cooling mode, the system will identify the warmest zone(s), and reset the supply air temperature to match this particular load. Likewise, when in heating mode, the system will identify the coldest zone(s), and reset the supply air temperature to match this particular load. For example, if Zone No. 1 is experiencing a thermal load of +2° F. while the system is in cooling mode (such zone experiencing the highest thermal load within the building), the system can reset the supply air temperature (by further cooling the supply air) in an effort to cool Zone No. 1.

Based upon the particular system, it may be desirable to average all of the thermal load demand signals and reset the supply air accordingly, or to ignore the highest and lowest signal and reset the supply air in accordance with the remaining signals. System 10 provides the flexibility to perform in any of the mentioned manners. Moreover, even if controller 22 is not capable of communicating directly with the air handling unit, it can still provide a reset signal which can direct an operator to manually reset the supply air temperature of the air handling unit.

Under certain circumstances, the supply air may be colder than necessary when in cooling mode to adequately cool the individual zones of the building. In this situation, the individual flow control boxes will restrict the air flow into the respective zones thereby reducing the air flow below the maximum flow volume value. As will be appreciated by those skilled in the art, reduced air flow into a particular zone increases the likelihood of "dumping" and decreases the indoor air quality (due to less fresh air being directed into the zone). If system 10 recognizes that a certain preselected number of flow control boxes are operating in a restricted mode (by measuring a controller signal of less than 50%), the system can reset the supply air temperature (by raising the temperature of such supply air) in an effort to decrease the refrigeration load on the system (resulting in savings in energy costs) and to increase the air flow into the particular zones (decreasing the likelihood of "dumping" and improving IAQ). Likewise, in heating mode, overheated supply air may cause the flow control boxes to operate in a restricted mode, thereby increasing energy costs and reducing IAQ.

Thus, controller 22 can provide a reset signal for the resetting of the supply air temperature (either automatically or manually) in response to an unmet cooling/heating load or when the supply air is colder/hotter than necessary to satisfy the thermal load(s) on the zone(s) of the VAV system. As a result, controller 22 can make up part of a Thermal Balance Control System, as more fully described in commonly-owned U.S. Provisional Application Ser. No. 60/512,410 filed on Oct. 17, 2003, the disclosure of which is hereby incorporated by reference.

The second task of controller 22 can be understood with reference to FIGS. 3–6. Turning first to FIG. 3, the chart describes a variable air volume system including ten separate zones indicated by box numbers 1–10. Referring particularly to Zone No. 1, FIG. 3 indicates that the VAV box for Zone No. 1 is providing 1,000 cubic feet per minute (CFM) of supply air into such zone, the supply air having a supply air temperature of 62.7° F. The set point for Zone No. 1 is 75° F., while the actual measured room temperature for Zone No. 1 is 76° F., thereby providing a +1° deviation. A total of 14,256 BTU/hour of cooling is being supplied to Zone No. 1. As indicated, Zone No. 1 is experiencing the greatest thermal load of all the zones. Similar data is supplied in FIG. 3 for Zone Nos. 2–10.

Referring now to FIG. 4, the actual room temperature in Zone No. 1 has increased to 76.5° F., thus providing a deviation of +1.5°. This increase in the sensible thermal load of Zone No. 1 results in the resetting of the supply air temperature (either automatically or manually) to 56.2° F., i.e., a decrease of 6.6°. In a typical prior art variable air volume system, this decrease in supply air temperature (from 62.8° F. to 56.2° F.) will cause an increase in the thermal transfer rate for each particular zone.

Comparing FIG. 3 to FIG. 4, the thermal transfer rate for Zone No. 1 increased from 14,256 BTU/hour to 21,924 BTU/hour. This increase in the thermal transfer rate for Zone No. 1 is in response to the 0.5° increase in actual room temperature of Zone No. 1. However, inasmuch as Zone Nos. 2–10 did not experience any change in room temperature, any change in the thermal transfer rate to such zones is undesirable, and will likely result in the temperature moving outside of the desired temperature range.

For example, comparing Zone No. 2 from FIG. 3 to FIG. 4, it is seen that the decrease in supply air temperature from 62.8° F. to 56.2° F. increases the thermal transfer rate from 13,986 BTU/hour to 21,114 BTU/hour (because the volume of supply air being directed into zone 2 remains at 1,000 CFM). It will be appreciated by those skilled in the art that a flow control box will only respond to a change in supply air temperature "after the facts" In other words, the flow control box will continue supplying 1,000 CFM of supply air to the particular zone, even though the supply air temperature has changed. As a result, the temperature in the room rapidly decreases and will likely move outside the desired temperature range. By the time the thermostat in the room signals the flow control box to limit the airflow into such room, the room has already moved outside the desired temperature range. As a result, the decrease in supply air temperature of 62.8°–56.2° will likely cause Zone Nos. 2–10 to undergo unwanted (and unlikely uncomfortable) temperature swings.

Turning now to FIG. 5, this chart depicts how the VAV system of the present invention responds to a change in the supply air temperature. Again, the actual room temperature of Zone No. 1 has increased by 0.50, thus causing the system to reset the supply air temperature from 62.8° F. to 56.2° F. This de crease in the temperature of the supply air, together with the noted supply air volume of 1000 CFM, provides a thermal transfer rate of 21,924 BTU/hour. Thus, the data associated with Zone No. 1 on FIG. 5 is identical to the data associated with Zone No. 1 on FIG. 4. As mentioned earlier, the increase in thermal transfer rate with respect to Zone No. 1 results from an actual increase in the thermal load being experienced by Zone No. 1, (e.g., additional lights and/or machinery being turned on).

However, as mentioned hereinabove, the actual measured room temperature of Zone Nos. 2–10 has not changed. Thus, controller 22, when measuring a change in the supply air temperature, recognizes that the change in such supply air temperature will cause the thermal transfer rate to change (as seen in FIG. 4) unless the air flow volume is changed. The controller recognizes that the thermal transfer rate previously being supplied to the zones (e.g., 13,986 BTU/hour for Zone No. 2—see FIG. 3) was sufficient to maintain such zones within the desired temperature range, and maintains the thermal transfer rate at substantially the same value (despite the change in the supply air temperature) by adjusting the flow volume into the zone.

The thermal transfer rate is calculated in accordance with the following equation: Thermal Transfer Rate (BTU/hour)= Flow Volume (CFM)×1.08×(Room Temperature−Supply Air Temperature). Because controller 22 has already calculated the thermal transfer rate for each particular zone (see FIG. 3), the controller is capable of using the aforementioned thermal transfer equation to recalculate the flow volume in response to a change in the temperature of the supply air (while maintaining the thermal transfer rate at a substantially constant value). As shown in FIG. 5, controller 22 recalculated the flow volume for Zone No. 2 as requiring 662.4 CFM to maintain the same thermal transfer rate as shown in FIG. 3.

Thus, a change in the supply air temperature will cause controller 22 to recalculate the air flow volume, and thereafter signal the individual flow control boxes to adjust the volume of air flow being directed into each individual zone. It will be appreciated by those skilled in the art that this recalculation of air flow volume and readjustment of flow volume through the individual flow control boxes occurs substantially simultaneously with (or shortly after) a change in the supply air temperature. As a result, the individual flow control boxes have anticipated and have already compensated for the change in temperature of the supply air, and the measured room temperature in each of the zones should remain substantially constant. In the event that the zone temperature and the supply air temperture change at the same time, the change in the supply air temperature will take priority.

To perform the mentioned functions, controller 20 preferably includes a hardware/software unit, e.g., a processor circuit, which is capable of receiving various input signals (e.g., flow volume, room temperature, supply air temperature and set point temperature), performing calculations (e.g., thermal transfer rate) and outputting representative signals (e.g., adjusted flow volume). Controller 22 may be preprogrammed, or may be programmable by the system operator.

Referring now to FIG. 6, the data from FIG. 4 and FIG. 5 have been combined into one chart. It can be seen from FIG. 6 that the variable air volume system of the present invention requires a total of 6,526.5 $ft^3$/min of supply air vs. 9,739.95 $ft^3$/min of supply air for a conventional VAV system, a difference of approximately 49.24%. Similarly, the VAV system of the present invention requires a total of 129,551.8 BTU/hour, while the conventional VAV system requires 191,850.1 BTU/hour, a difference of approximately 48%. It is believed that such reductions in air flow and BTU transfer will result in both improved performance and increased efficiency for the system of the present invention.

The controller of the present invention is thus a dynamic real time controller that continuously measures both the sensible thermal load (the deviation of the room temperature from the set point) and the supply air temperature, and adjusts the air flow volume through the flow control box to both match the sensible thermal load in the zone and to maintain a constant thermal transfer rate notwithstanding changes in the supply air temperature. Moreover, the controller of the present invention provides an output signal representative of an unmet thermal load in the zone (which can be used to reset the supply air temperature). Finally, the output signals of the individual controllers of the VAV system can be used to monitor overcooling/overheating of the supply air, and provide a signal for resetting of the supply air temperature under certain conditions.

It will be appreciated that the present invention has been described herein with reference to certain preferred or exemplary embodiments. The preferred or exemplary embodiments described herein may be modified, changed, added ot or deviated from without departing from the intent, spirit and scope of the present nvention, and it is intended that all such additions, modifications, amendment and/or deviations be included within the scope of the following claims.

What is claimed is:

1. A method of controlling room temperature within a zone of a variable air volume system, said system including a flow control box associated with said zone for regulating flow volume of supply air into said zone, said supply air having a temperature T, comprising the steps of:

calculating a thermal transfer rate for said zone based upon said supply air temperature and said flow volume into said zone;

calculating an adjusted air flow volume for said zone in response to a change in said supply air temperature while maintaining said thermal transfer rate at a substantially constant value; and setting said flow control box to said adjusted air flow volume whereby said thermal transfer rate with respect to said zone remains at said substantially constant value notwithstanding the change in temperature of said supply air thus substantially maintaining said room temperature within a predefined temperature range.

2. The method according to claim 1, wherein said thermal transfer rate is calculated in accordance with the formula:

Thermal Transfer Rate (BTU/hour)=Flow Volume (cubic feet per minute)×1.08×(Room Temperature−Supply Air Temperature).

3. The method according to claim 2, further comprising the initial step of regulating said flow volume of said supply air entering said zone until said room temperature is within said predefined temperature range.

4. The method according to claim 3, further comprising the step of monitoring the temperature of said supply air and signaling said system to calculate said adjusted air flow volume in response to a preselected change in temperature of said supply air.

5. The method according to claim 4, wherein said preselected change is at least 1.0° F.

6. The method according to claim 5, wherein said preselected change is at least 3.0° F.

7. The method according to claim 5, wherein said zone has a set point temperature, and wherein said predefined temperature range is less than or equal to ±1.0° F. with respect to said set point temperature.

8. The method according to claim 6, wherein said zone has a set point temperature, and wherein said predefined temperature range is less than or equal to ±0.5° F. with respect to said set point temperature.

9. The method according to claim 7, further comprising the step of measuring flow volume into said zone.

10. The method according to claim 9, further comprising the step of calculating a revised thermal transfer rate for said zone following a change in said flow volume into said zone due to a variation in thermal load within said zone.

11. A controller for controlling room temperature within at least one zone of a variable air volume system, said system including a flow control box associated with said zone for regulating flow volume of supply air into said zone, said supply air having a temperature T, comprising:

at least one processor circuit for calculating a thermal transfer rate for said zone based upon said supply air temperature and said flow volume into said zone and for calculating an adjusted flow volume for said zone in response to a change in said supply air temperature while maintaining said thermal transfer rate at a substantially constant value; and an electrical output device for communicating said adjusted flow volume to said flow control box whereby said thermal transfer rate with respect to said zone remains at said substantially constant value notwithstanding the change in temperature of said supply air thus substantially maintaining said room temperature within a predefined temperature range.

12. The controller according to claim 11, wherein said processor circuit utilizes the formula:

Thermal Transfer Rate (BTU/hour)=Flow Volume (cubic feet per minute)×1.08×(Room Temperature−Supply Air Temperature).

13. The controller according to claim 12, wherein said adjusted flow volume is calculated in response to a change in said supply air temperature of at least 1.0° F.

14. The controller according to claim 13, wherein said adjusted flow volume is calculated in response to a change in said supply air temperature of at least 3.0° F.

15. The controller according to claim 13, wherein said zone has a set point temperature, and where said predefined temperature range is less than or equal to ±1.0° F. with respect to said set point temperature.

16. The controller according to claim 15, wherein said zone has a set point temperature, and where said predefined temperature range is less than or equal to ±0.5° F. with respect to said set point temperature.

17. The controller according to claim 15, wherein said output device provides an output signal, and said output signal varies between 0% and 100%, and wherein a first portion of said output signal corresponds to control of said flow control box and a second portion of said output signal provides an indication of an unmet thermal load.

18. The controller according to claim 17, wherein said first portion corresponds to an output signal of 0% to 50%, and said second portion corresponds to an output signal of 50% to 100%.

19. The controller according to claim 18, wherein said flow control box provides maximum flow volume at an output signal of 50% or greater.

20. The controller according to claim 17, further comprising a plurality of electrical inputs for receiving a plurality of electrical signals, said electrical signals representative of: i) said flow volume into said zone; ii) said room temperature; iii) said supply air temperature; and iv) said set point temperature.

21. A variable air volume system for environmental control of a plurality of zones within a building, comprising:

at least one air handling unit for providing supply air at a preselected temperature;

a supply duct for transporting said supply air from said air handling unit to said individual zones;

a flow control box associated with each of said zones for regulating flow volume of supply air into said associated zone; and at least one controller for controlling room temperature within each of said zones, said controller comprising:

at least one processor circuit for calculating a thermal transfer rate for said zone based upon said supply air temperature and said flow volume into said zone and for calculating an adjusted flow volume for said zone in response to a change in said supply air temperature while maintaining said thermal transfer rate at a substantially constant value; and an electrical output device for communicating said adjusted flow volume to said flow control box whereby said thermal transfer rate with respect to said zone remains at said substantially constant value notwithstanding the change in temperature of said supply air thus substantially maintaining said room temperature within a predefined temperature range; and wherein said processor circuit utilizes the formula:

Thermal Transfer Rate (BTU/hour)=Flow Volume (cubic feet per minute)×1.08×(Room Temperature−Supply Air Temperature).

22. The system according to claim 21, wherein each of said flow control boxes includes an independent controller associated therewith.

23. The system according to claim 22, further comprising a sensor for measuring said supply air temperature, and wherein each of said flow control boxes includes a flow sensor for measuring said flow volume into said associated zone.

24. The system according to claim 23, wherein said adjusted flow volume is calculated in response to a change in said supply air temperature of at least 1.0° F.

25. The system according to claim 24, wherein said adjusted flow volume is calculated in response to a change in said supply air temperature of at least 3.0° F.

26. The system according to claim 24, wherein said zone has a set point temperature, and where said predefined temperature range is less than or equal to ±1.0° F. with respect to said set point temperature.

27. The system according to claim 26, wherein said zone has a set point temperature, and where said predefined temperature range is less than or equal to ±0.5° F. with respect to said set point temperature.

28. The system according to claim 26, wherein said controller provides an output signal, and said output signal varies between 0% and 100%, and wherein a first portion of said output signal corresponds to control of said flow control box and a second portion of said output signal provides an indication of said unmet thermal load.

29. The system according to claim 28, wherein said first portion corresponds to an output signal of 0% to 50%, and said second portion corresponds to an output signal of 50% to 100%, and wherein said flow control box provides maximum flow volume at an output signal of 50% or greater.

30. The system according to claim 29, wherein each of said controllers is in electrical communication with one another.

* * * * *

UNITED STATES PATENT AND TRADEMARK OFFICE

CERTIFICATE OF CORRECTION

PATENT NO. : 6,879,881 B1
DATED : April 12, 2005
INVENTOR(S) : Russell G. Attridge, Jr.

It is certified that error appears in the above-identified patent and that said Letters Patent is hereby corrected as shown below:

Column 7,
Line 22, now reads "temperature is 74°, a +20 temperature" should read -- temperature is 74°, a +2° temperature --.

Column 8,
Line 55, now reads "supply air temperature of 62.7° F." should read -- supply air temperature of 62.8° F. --.

Column 9,
Line 35, now reads "has increased by 0.50, thus" should read -- has increased by 0.5°, thus --.

Signed and Sealed this

Sixth Day of September, 2005

JON W. DUDAS
*Director of the United States Patent and Trademark Office*